US009605929B1

(12) United States Patent
Handley

(10) Patent No.: US 9,605,929 B1
(45) Date of Patent: Mar. 28, 2017

(54) BULLET DEFLECTION SHIELD

(71) Applicant: Toni Bill Handley, Midland, TX (US)

(72) Inventor: Toni Bill Handley, Midland, TX (US)

( * ) Notice: Subject to any disclaimer, the term of this patent is extended or adjusted under 35 U.S.C. 154(b) by 0 days.

(21) Appl. No.: 15/353,610

(22) Filed: Nov. 16, 2016

(51) Int. Cl.
*F41H 5/18* (2006.01)
*F41H 5/24* (2006.01)
*F41H 5/013* (2006.01)

(52) U.S. Cl.
CPC ..... *F41H 5/18* (2013.01); *F41H 5/013* (2013.01); *F41H 5/24* (2013.01)

(58) Field of Classification Search
CPC ..... F41H 5/013; F41H 5/18; F41H 5/24
See application file for complete search history.

(56) References Cited

U.S. PATENT DOCUMENTS 3,478,643 A * 11/1969 Forsyth ..... F41H 5/14 89/36.08
3,590,685 A * 7/1971 Lane ..... F41H 5/14 109/49.5
8,006,606 B1 * 8/2011 Petrosillo ..... F41H 5/18 89/36.07
2003/0008097 A1 * 1/2003 Durst ..... B32B 3/10 428/54
2005/0022658 A1 * 2/2005 Bateman ..... F41J 13/00 273/410
2005/0262999 A1 * 12/2005 Tomczyk ..... F41H 5/0457 89/36.02
2009/0100997 A1 * 4/2009 Fuqua ..... F41H 5/013 89/36.02
2010/0281416 A1 * 11/2010 Fuyuno ..... G06F 1/162 715/773
2012/0060436 A1 * 3/2012 Zimmer, II ..... F41H 5/06 52/202
2015/0292841 A1 * 10/2015 Fultz ..... F41H 5/226 89/36.04

* cited by examiner

*Primary Examiner* — Gabriel Klein
(74) *Attorney, Agent, or Firm* — Plager Schack LLP

(57) ABSTRACT

A bullet shield is configured to deflect bullets. The bullet shield includes a first panel, attached to a first panel upper hinge and a first panel lower hinge. A second panel is immediately adjacent to the first panel forming a first panel seam therebetween. The second panel is attached to a second panel upper hinge and a second panel lower hinge. An upper second panel support reinforcement, attached to the first panel and the second panel covering all of the first panel seam. A second panel support reinforcement is attached to the second panel. A first panel secondary support reinforcement is attached to the upper second panel support reinforcement and the second panel support reinforcement. Bullets fired at the bullet shield are deflected from the bullet shield to protect a user behind the bullet shield.

6 Claims, 3 Drawing Sheets

BULLET DEFLECTION SHIELD

BACKGROUND

The embodiments herein relate generally to devices for defense in an active shooter situation.

Prior to embodiments of the disclosed invention, surviving an active shooter situation was challenging. Embodiments of the disclosed invention solve that problem.

SUMMARY

A bullet shield is configured to deflect bullets. The bullet shield includes a first panel, attached to a first panel upper hinge and a first panel lower hinge. A second panel is immediately adjacent to the first panel forming a first panel seam therebetween. The second panel is attached to a second panel upper hinge and a second panel lower hinge. An upper second panel support reinforcement, attached to the first panel and the second panel covering all of the first panel seam. A second panel support reinforcement is attached to the second panel. A first panel secondary support reinforcement is attached to the upper second panel support reinforcement and the second panel support reinforcement. Bullets fired at the bullet shield are deflected from the bullet shield to protect a user behind the bullet shield.

In some embodiments, the bullet shield of claim 1 includes a third panel, immediately adjacent to a second panel. A third panel upper hinge and a third panel lower hinge, are attached to the third panel.

In some embodiments, a lower second panel support reinforcement is attached to the third panel and the second panel. A third panel support reinforcement is attached to the third panel. A third panel secondary support reinforcement is attached to the lower second panel support reinforcement and the third panel support reinforcement.

An interior portion of a hallway wall is attached to the first panel upper hinge, the first panel lower hinge, the second panel upper hinge, the second panel lower hinge, the third panel upper hinge and the third panel lower hinge.

In some embodiments, a center line is perpendicular to the hallway wall. An effective angle, measured counterclockwise between the center line and the bullet shield. The effective angle can be at least 15 degrees but no more than 80 degrees.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
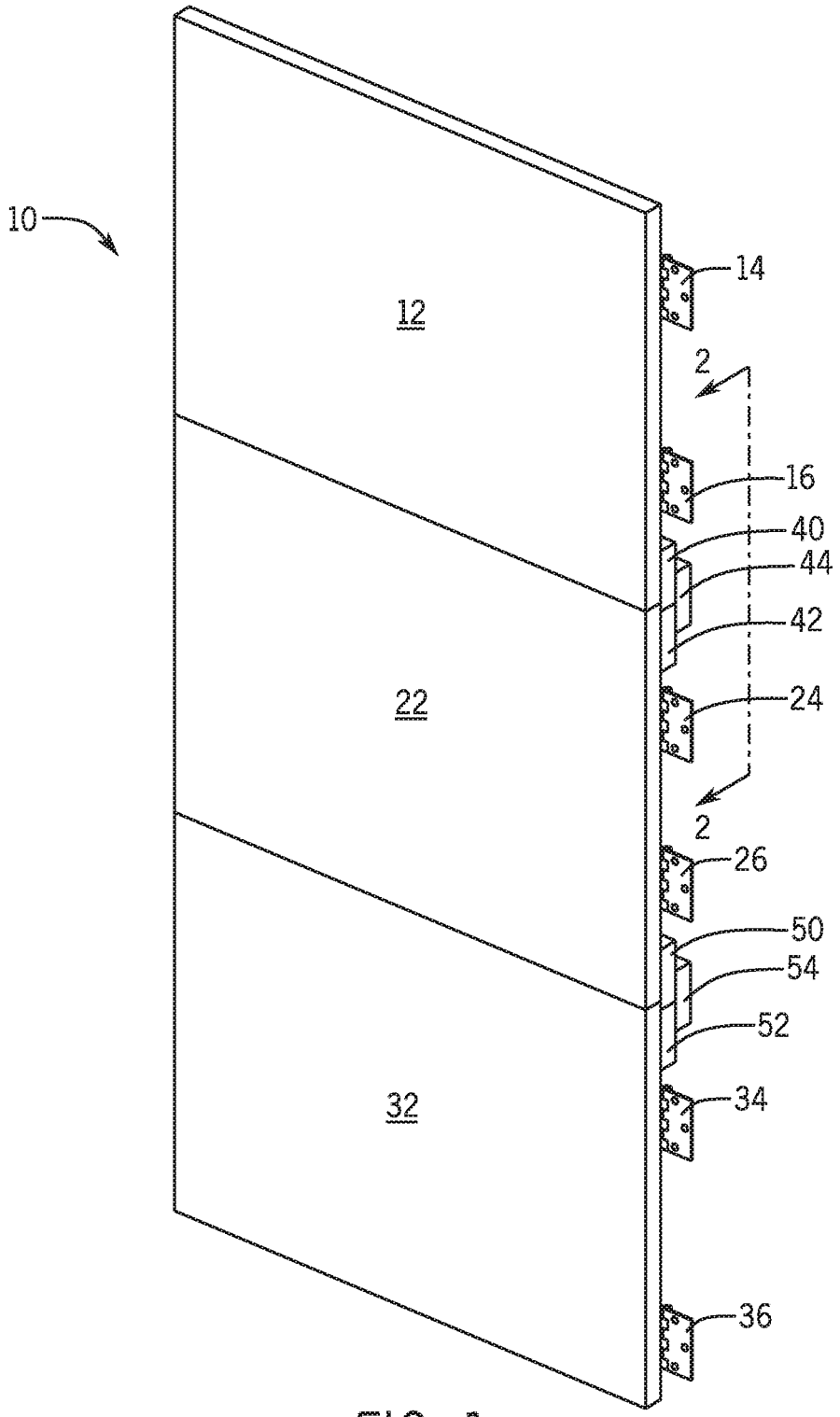
FIG. 1 shows a front perspective view of one embodiment of the present invention.
Figure 2:
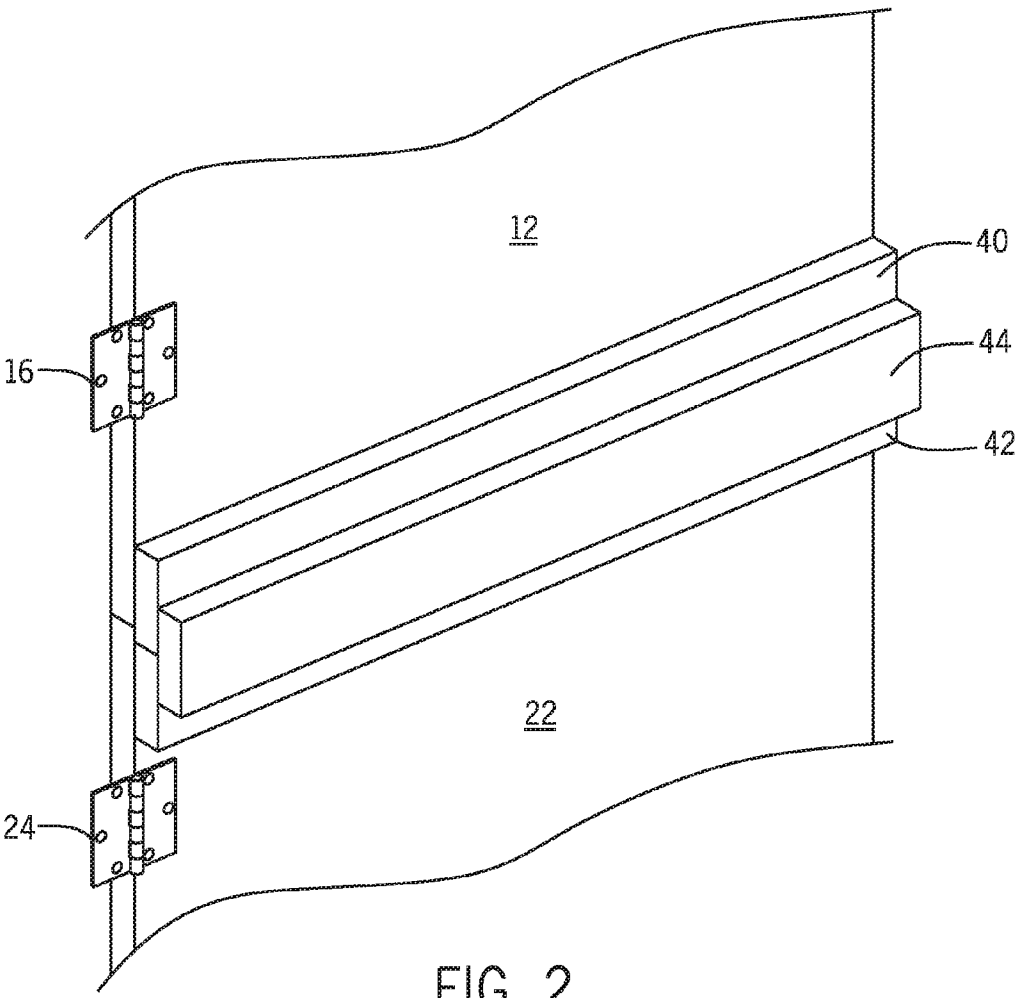
FIG. 2 shows a rear detail view of one embodiment of the present invention.

By way of example, and referring to FIG. 1, one embodiment of bullet shield 10 comprises first panel 12 attached to first panel upper hinge 14 and first panel lower hinge 16. First panel 12 is immediately adjacent to second panel 22 with an upper seam therebetween. Second panel 22 is attached to second panel upper hinge 24 and second panel lower hinge 26. Second panel 22 is immediately adjacent to third panel 32 with a lower seam therebetween. Third panel 32 is attached to third panel upper hinge 34 and third panel lower hinge 36.

First panel 12 and second panel 22 are attached to upper second panel support reinforcement 40. Second panel 22 is attached to second panel support reinforcement 42. Upper second panel support reinforcement 40 and second panel support reinforcement 42 are attached to first panel secondary support reinforcement 44.

Third panel 32 and second panel 22 are attached to lower second panel support reinforcement 50. Third panel 32 is attached to third panel support reinforcement 52. Lower second panel support reinforcement 50 and third panel support reinforcement 52 are attached to third panel secondary support reinforcement 54.

In some embodiments, first panel 12, second panel 22 and third panel 32 and be ⅛-inch-thick steel plates measuring 2.5 feet wide and 2 feet tall each. Upper second panel support reinforcement 40, second panel support reinforcement 42, first panel secondary support reinforcement 44, lower second panel support reinforcement 50, third panel support reinforcement 52, and third panel secondary support reinforcement 54 can be smaller ⅛-inch-thick steel plates that are configured to prevent bullet fragments from passing through the seams between first panel 12 and second panel 22 and between second panel 22 and third panel 32.

Figure 3:
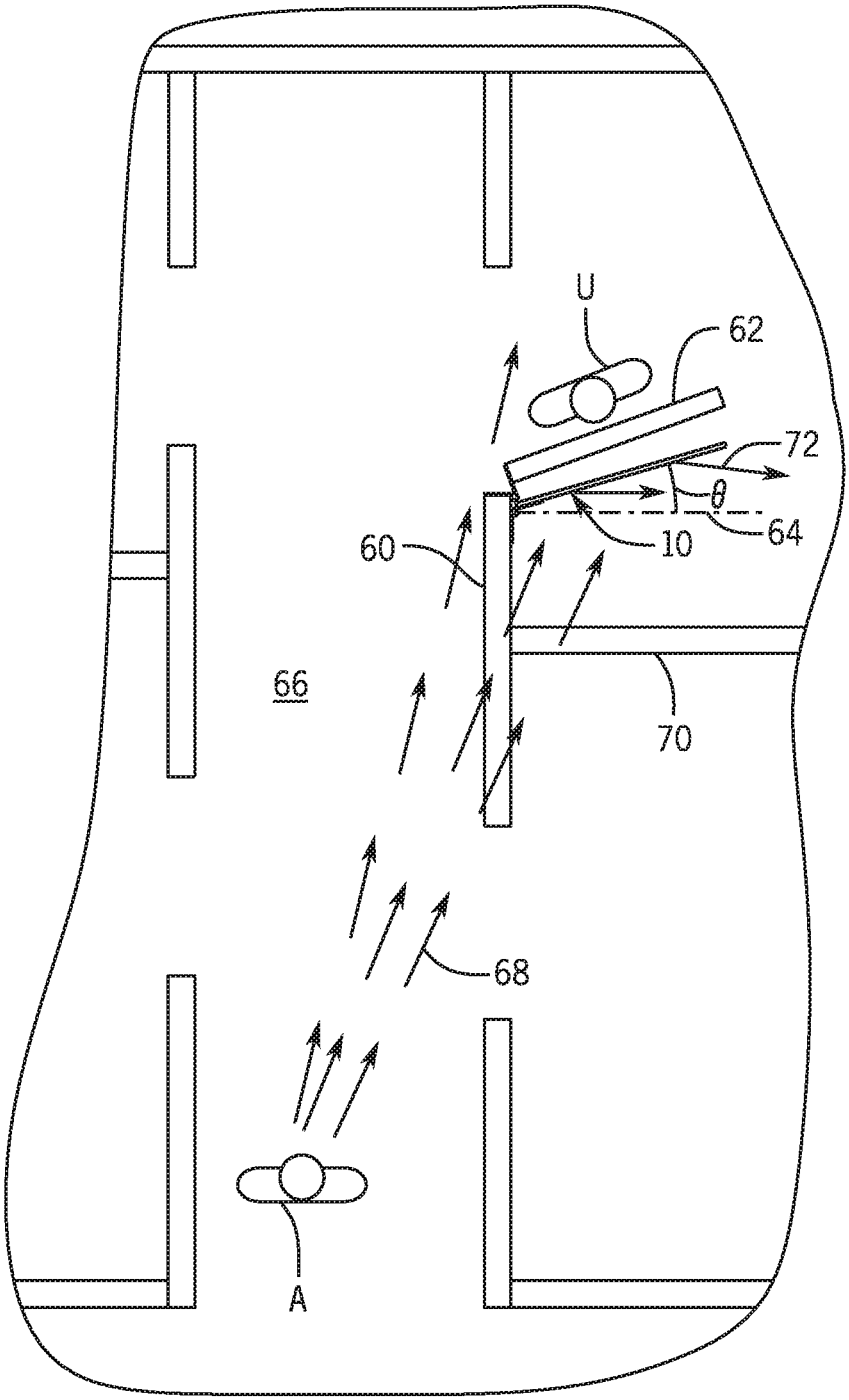
FIG. 3 shows a top view of one embodiment of the present invention shown in use.

Turning to FIG. 3, in some embodiments, first panel upper hinge 14, first panel lower hinge 16, second panel upper hinge 24, second panel lower hinge 26, third panel upper hinge 34 and third panel lower hinge 36 are attached to an interior portion of hallway wall 60 proximate hallway door 62. Perpendicular to of hallway wall 60 is center line 64. Effective angle θ is measured counterclockwise between center line 64 and bullet shield 10. In order for bullet shield 10 to be effective, effective angle θ should be at least 15 degrees but no more than 80 degrees.

Assailant A in hallway 66 fires bullets 68 through hallway wall 60 and interior wall 70. However those bullets 68 that threaten user U are deflected bullets 72 that travel off of bullet shield 10 and away from user U.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bullet shield, configured to deflect bullets; the bullet shield comprising:

a first panel, attached to a first panel upper hinge and a first panel lower hinge;

a second panel, immediately adjacent to the first panel forming a first panel seam therebetween; wherein the second panel is attached to a second panel upper hinge and a second panel lower hinge;

an upper second panel support reinforcement, attached to the first panel and the second panel covering all of the first panel seam;

a second panel support reinforcement, attached to the second panel;

a first panel secondary support reinforcement, attached to the upper second panel support reinforcement and the second panel support reinforcement;

wherein bullets fired at the bullet shield are deflected from the bullet shield to protect a user behind the bullet shield.

2. The bullet shield of claim 1, further comprising:

a third panel, immediately adjacent to a second panel;

a third panel upper hinge and a third panel lower hinge, attached to the third panel.

3. The bullet shield of claim 2, further comprising:

a lower second panel support reinforcement attached to the third panel and the second panel;

a third panel support reinforcement, attached to the third panel; and a third panel secondary support reinforcement, attached to the lower second panel support reinforcement and the third panel support reinforcement.

4. The bullet shield of claim 3, further comprising:

an interior portion of a hallway wall, attached to the first panel upper hinge, the first panel lower hinge, the second panel upper hinge, the second panel lower hinge, the third panel upper hinge and the third panel lower hinge.

5. The bullet shield of claim 4, further comprising: a center line, perpendicular to the hallway wall; an effective angle, measured counterclockwise between the center line and the bullet shield.

6. The bullet shield of claim 5, wherein the effective angle is at least 15 degrees but no more than 80 degrees.

* * * * *